US007806309B2

(12) United States Patent
Korchmar

(10) Patent No.: US 7,806,309 B2
(45) Date of Patent: Oct. 5, 2010

(54) ARTICLE STORAGE BAG

(76) Inventor: Michael D. Korchmar, 5025 Drake Rd., Indian Hill, OH (US) 45243

( * ) Notice: Subject to any disclaimer, the term of this patent is extended or adjusted under 35 U.S.C. 154(b) by 979 days.

(21) Appl. No.: 11/363,717

(22) Filed: Feb. 28, 2006

(65) Prior Publication Data

US 2007/0199966 A1 Aug. 30, 2007

(51) Int. Cl.
*A45C 15/00* (2006.01)
*A45F 3/02* (2006.01)
*A45F 4/00* (2006.01)

(52) U.S. Cl. ..... 224/578; 224/183; 224/610; 224/612; 224/615; 224/616

(58) Field of Classification Search ..... 224/183, 224/578, 610, 612, 614, 615, 616, 620, 655; 150/107–110; 24/303
See application file for complete search history.

(56) References Cited

U.S. PATENT DOCUMENTS

| | | | | | |
|---|---|---|---|---|---|
| 1,979,978 | A | * | 11/1934 | Martin | 190/115 |
| 2,432,001 | A | | 10/1946 | Fisler | |
| 3,001,566 | A | * | 9/1961 | Lipsitz | 224/610 |
| 3,186,461 | A | | 6/1965 | Erickson | |
| 3,319,852 | A | | 5/1967 | Perkins | |
| 3,963,102 | A | | 6/1976 | Carp | |
| 4,121,324 | A | | 10/1978 | Marbacher | |
| 4,151,938 | A | | 5/1979 | Barker et al. | |
| D258,702 | S | | 3/1981 | Weinreb | |
| 4,257,463 | A | | 3/1981 | Monaco | |
| D270,494 | S | | 9/1983 | Koszegi | |
| 4,480,361 | A | | 11/1984 | Morita | |
| D278,857 | S | | 5/1985 | Katz et al. | |
| 4,736,494 | A | | 4/1988 | Marchesi | |
| 4,779,314 | A | | 10/1988 | Aoki | |
| 4,882,815 | A | * | 11/1989 | Nilsen | 24/303 |
| 4,978,044 | A | | 12/1990 | Silver | |
| 5,042,116 | A | | 8/1991 | Ossiani | |
| 5,044,538 | A | | 9/1991 | Bader | |
| 5,560,089 | A | * | 10/1996 | Morita | 24/303 |
| D380,295 | S | | 7/1997 | Morris | |
| 5,887,770 | A | * | 3/1999 | Covell | 224/153 |
| 5,920,966 | A | * | 7/1999 | Chen | 24/303 |
| 5,927,450 | A | * | 7/1999 | Sadow | 190/102 |
| 5,983,464 | A | | 11/1999 | Bauer | |
| 5,987,715 | A | | 11/1999 | Khon | |

(Continued)

FOREIGN PATENT DOCUMENTS

FR 2 521 839 A1 8/1983

(Continued)

OTHER PUBLICATIONS

ISA Partial International Search mailed Jul. 31, 2007.

(Continued)

*Primary Examiner*—Nathan J Newhouse
*Assistant Examiner*—Adam Waggenspack
(74) *Attorney, Agent, or Firm*—Wood, Herron & Evans, L.L.P.

(57) ABSTRACT

An article storage bag is described, having a concealed magnetic closure system and concealed strap adjustment system. The bag presents a clean appearance, without any apparent components for adjusting the carrying strap length.

21 Claims, 6 Drawing Sheets

U.S. PATENT DOCUMENTS

| | | | | |
|---|---|---|---|---|
| 5,988,474 | A * | 11/1999 | Smith et al. | 224/578 |
| 6,215,381 | B1 * | 4/2001 | Aoki | 335/207 |
| 6,295,702 | B1 | 10/2001 | Bauer | |
| 6,305,656 | B1 * | 10/2001 | Wemyss | 248/309.4 |
| 6,390,345 | B1 * | 5/2002 | Brown et al. | 224/578 |
| 6,434,801 | B2 | 8/2002 | Grunberger | |
| 6,446,688 | B1 | 9/2002 | Sutton | |
| 6,496,094 | B2 * | 12/2002 | May, III | 335/285 |
| 6,505,385 | B2 | 1/2003 | Grunberger | |
| 6,622,899 | B1 * | 9/2003 | Klindworth-Garron | 224/578 |
| 6,637,484 | B1 * | 10/2003 | Kraft | 150/112 |
| 6,675,448 | B2 | 1/2004 | Revel | |
| 6,796,344 | B2 * | 9/2004 | Chen et al. | 150/113 |
| 6,977,809 | B2 | 12/2005 | Bovino | |
| 7,059,371 | B2 * | 6/2006 | Renn | 150/101 |
| 2002/0000024 | A1 | 1/2002 | Grunberger | |
| 2002/0108688 | A1 | 8/2002 | Reiss | |
| 2003/0131452 | A1 | 7/2003 | Revel | |
| 2004/0206430 | A1 | 10/2004 | Chang | |
| 2005/0224547 | A1 * | 10/2005 | Krulik et al. | 224/578 |

FOREIGN PATENT DOCUMENTS

| | | |
|---|---|---|
| WO | 99/53799 | 10/1999 |

OTHER PUBLICATIONS

European Patent Office PCT International Search Report, International Application PCT/US2007/062664, mailed Oct. 17, 2007.
European Patent Office PCT Written Opinion of the ISA, International Application PCT/US2007/062664, mailed Oct. 17, 2007.

* cited by examiner

ARTICLE STORAGE BAG

FIELD OF THE INVENTION

The invention relates to article storage bags, and more specifically to personal bags for carrying documents, equipment and the like.

BACKGROUND OF THE INVENTION

Article storage bags have been manufactured and sold in a variety of configurations. Typically, the article storage bag will contain one or more compartments within the bag to store items, such as documents, computers, electronic devices, calculators, writing instruments, and other personal items such as wallets, keys and the like.

Article storage bags are generally transported from place to place by either clutching the bag under one's arm, carrying the bag by means of a handle typically centered at the top of the bag, or by extending a strap connected to the bag over one's shoulder. Occasionally, some bags are fitted with harness systems having carrying straps which extend over both shoulders.

When using a strap for transporting a bag, typically the user will adjust the length of the strap with due consideration of the individual's height and other preferences of the user relative to the manner in which the bag will hang from the shoulder. After that initial adjustment, the bag strap is typically not adjusted again, particularly when the bag is used by one person. Many carrying straps show the adjustment means, such as by buckle or slide ring devices, in full view.

An article storage bag also typically contains a closure mechanism to limit access to the storage compartment of the bag. Closure mechanisms can include an array of latches, belt-buckle combinations, slides, and other devices. Where the bag includes a flap portion which overlies the storage compartment, one component of the closure mechanism is positioned typically on the underside or at the bottom edge of the flap. This component in turn mates with a complementary facing component on the front wall of the bag. The closure may have a feature which affirmatively locks the bag, but this is optional.

Because the bag is a personal item, style and fashion considerations also enter into the desirability of selecting one bag relative to others. There remains a need for article storage bags having desirable aesthetic features, as well as features which permit the bag to provide a valuable storage and carrying function for the owner.

BRIEF DESCRIPTION OF THE INVENTION

Described herein is an article storage bag having a concealed closure system and strap adjustment system. The article storage bag has a flap portion which overlies one or more article storage compartments located in the bag. The bag typically will include a carry handle which is secured to the flap and centered along the top of the bag. Alternatively, carrying and transport of the bag can be accomplished by use of a shoulder strap. The adjustment components of this strap are concealed within the bag such that the bag displays no external indication of adjustability.

The closure system for the article storage bag is concealed, and located out of direct view of the user. Mating magnets are positioned respectively within the article storage portion of the bag and the flap portion. Bringing these magnets inside a minimum distance effects the closure. The magnetic closure system is concealed behind the outermost material visible to the user. This material may be leather; canvas; cotton; a synthetic polymeric material such as polyester, vinyl, Cordura® nylon or ballistic nylon; and combinations of these materials. It is possible that still other materials may be used, as required for the specific end use application of the bag. The choice of outermost material composition is a function of the intended use of the bag as well as the desired fashion or design image to be conveyed.

An item which can be stored in a properly configured article storage bag is a laptop computer. One or more components of the laptop may be susceptible to the effect of the magnetic field generated in the vicinity of one or more of the magnetic closure components. Even in instances where non-susceptible paper documents or the like are the primary articles being carried, the user may also store and transport items such as floppy discs, audio tapes, credit cards, and the like, the functions of which may be adversely affected by a magnetic field. To address this potential risk, ferromagnetic materials are incorporated into the magnetic closure system in close relation to the magnets to assist in dissipating any stray magnetic flux density extending a distance away from the points of magnetic closure on the bag.

The magnetic closure system and concealed strap adjustment system can be incorporated into article storage bags used for storing and transporting a range of items, such as documents, personal laptop computers, calculators, writing instruments, wallets, audio playback devices, and other personal items. Thus, briefcases, computer storage bags, and overnighter-type bags can utilize the magnetic closure system and concealed strap adjustment system, but the term "article storage bag" is not intended to be limited to only these types of bags or cases.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the principles of the invention.

DETAILED DESCRIPTION OF THE INVENTION

Figure 1:
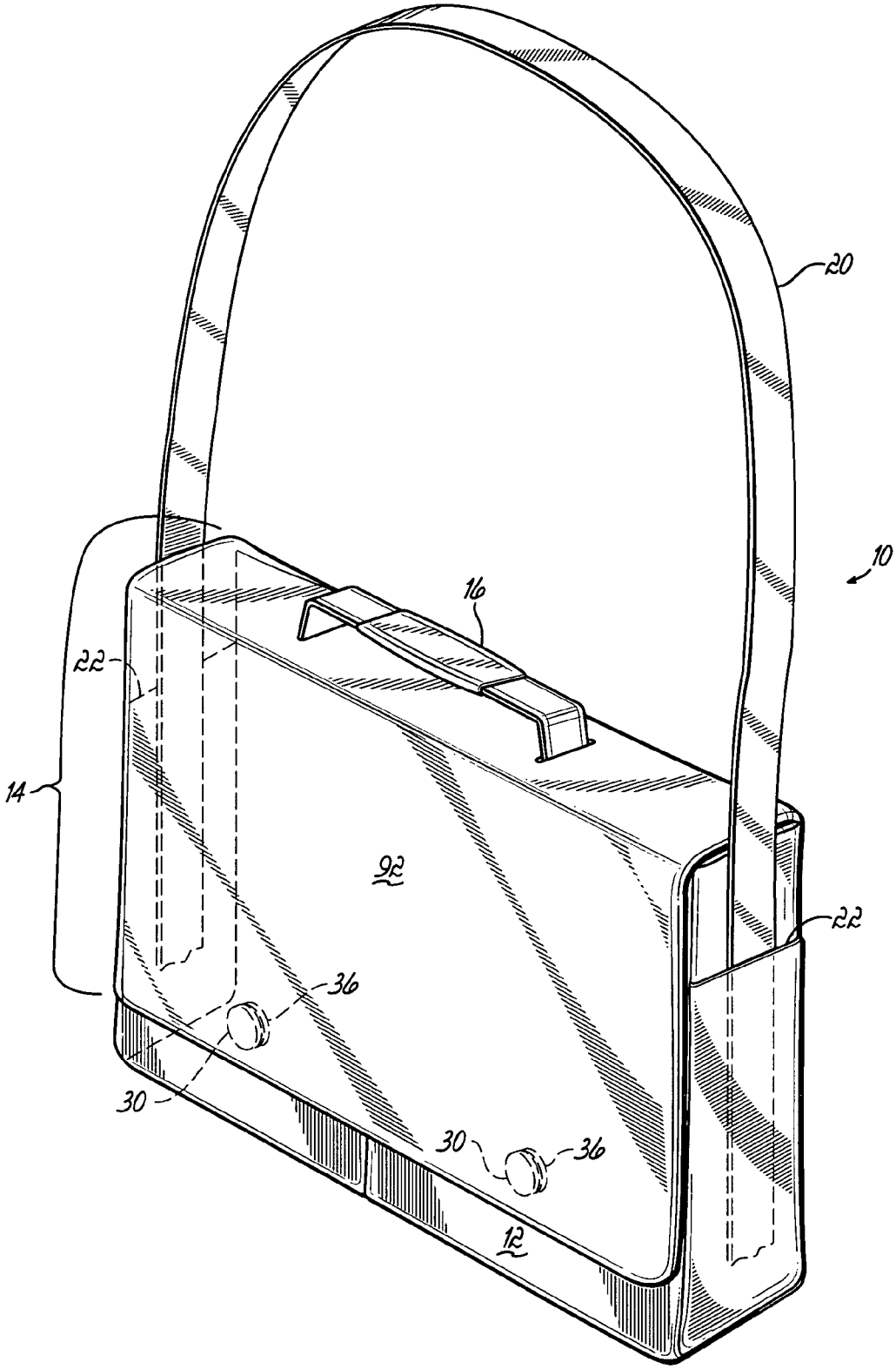
FIG. 1 is a perspective view of the article storage bag with the flap in the closed position.

The invention in its broader aspects relates to an article storage bag having a magnetic closure system. The invention further relates to an article storage bag having a concealed strap adjustment system. Access to the one or more article storage compartments of the bag is via a flap overlying the one or more storage compartments. The magnetic closure system, like the strap adjustment system, is not readily apparent to the viewer, the magnetic closure system being concealed beneath one or more layers of the materials used in the manufacture of the bag. The result of both the magnetic closure system and concealed strap adjustment system when applied to an article storage bag is to create an article storage bag having clean design lines; a smooth, finished appearance over the length of the exposed carry strap; the absence of any exposed fastening or locking hardware for limiting access to the one or more article storage compartments; and the ability to affirmatively secure and release the closure between the flap and the storage portion of the bag by one hand operation. The magnetic closure system is configured so that the magnetic attraction between mating magnets is not broken even when the article storage bag containing stored articles is lifted and carried by means of a handle centered on the flap at the top of the bag.

The bag can be constructed using a variety of materials for manufacturing article storage bags, such as but not limited to leather, canvas, cotton, a synthetic polymeric material such as polyester, vinyl, Cordura® nylon or ballistic nylon, and combinations of these materials. Construction of the article storage bag is by conventional techniques, by preparation of individual front, back, side, top and bottom panels for the bag. These panels in turn are used to fabricate internal storage compartments and external storage compartments which are joined together by known joining techniques, including stitching or gluing, or both. The magnetic closure system and concealed adjustment strap system can be readily used in combination with any of the above fabrication materials, without limitation.

Not only the selection of manufacturing materials, but also the material quality, material thickness and nature and quality of the underlying previously structural and aesthetic components used in the manufacturing process, will vary according to the end use application of the bag and the overall appearance desired by the manufacturer. Thus, a high quality price point leather bag will incorporate manufacturing materials, fabrication techniques, foam and substrate material thickness and quality, and other functional and aesthetic features not necessarily used in fabricating a bag made of a different material for a different purpose. The description below is directed to the fabrication of a leather personal bag, such as for storing and transporting a personal laptop computer, but variations in the fabrication materials and techniques can be employed, as deemed necessary, for the fabrication of a range of article storage bags using other materials.

Referring to the drawings, FIG. 1 depicts the article storage bag 10, which includes an article storage portion 12, a flap 14, a handle 16 secured to the flap 14 and centered along the top of the bag 10, and a carrying strap 20, the ends of which extend into receiver pockets 22. The carrying strap 20 can be used as shown, or can be fitted with an optional strap cushion (not shown) which would contact the shoulder area when the bag 10 is carried by means of the carrying strap 20. The article storage bag 10 as depicted shows two concealed flap magnets 30 in engagement with two bag magnets 36, though the engagement is not directly magnet-to-magnet. More or fewer magnets can be employed as part of the magnetic closure system, described in more detail below, as desired in the construction of particular article storage bags.

Figure 2:
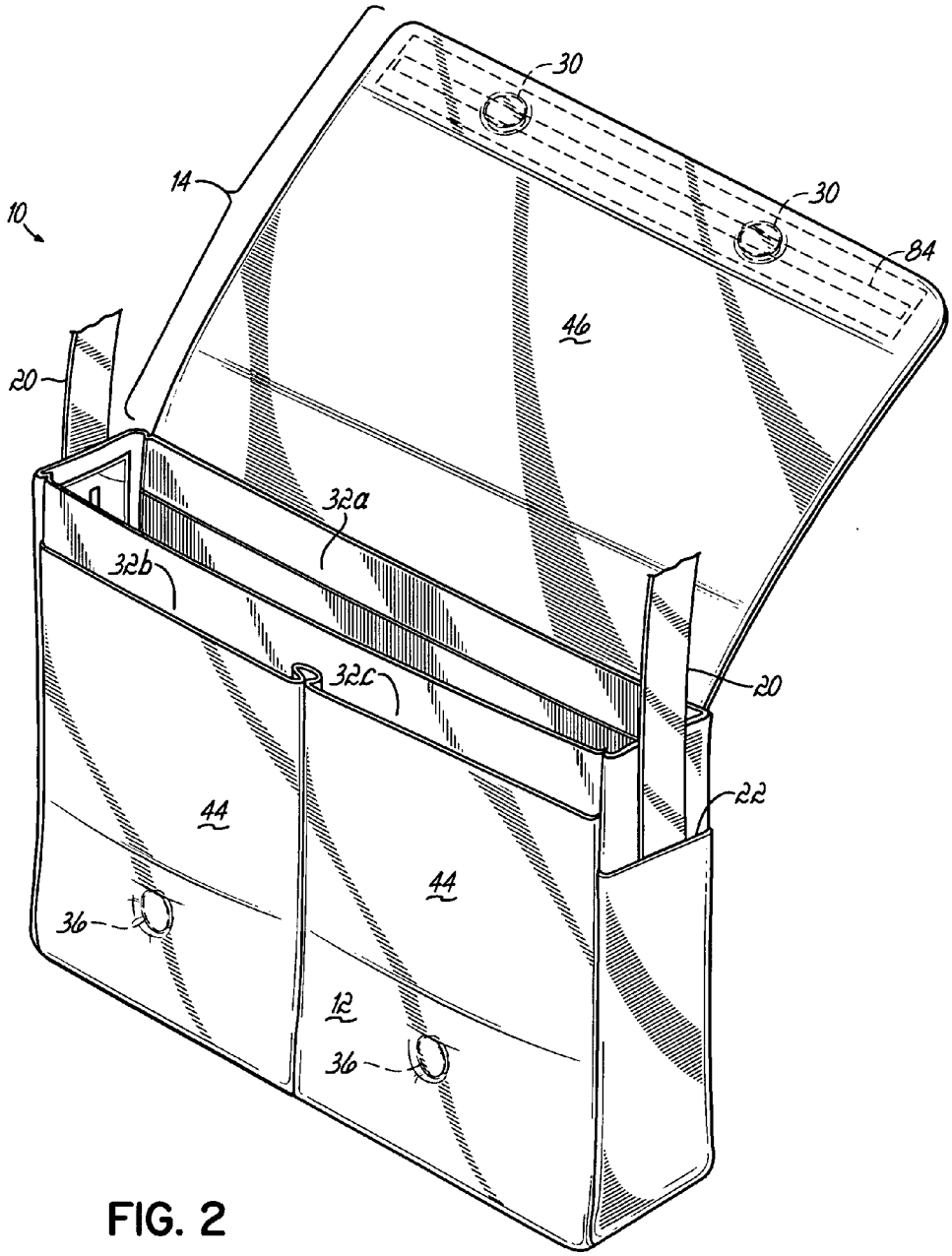
FIG. 2 is a perspective view of the article storage bag with the flap in the open position.

FIG. 2 shows the article storage bag 10 with the flap 14 in the open position. In the article storage portion 12 are article storage compartments 32*a*, 32*b* and 32*c*. Fewer or more compartments may be incorporated, as desired for the particular end use application. Article storage compartment 32*a* is sized to receive a personal laptop computer, but the storage volume can also be used for document, book or personal item storage. Smaller personal items, books and the like can be stored in article storage compartments 32*b* and 32*c*. Optionally, one or more additional external article storage compartments (not shown) can be incorporated into the article storage bag 10, for example on the reverse side of the article storage portion 12.

The article storage bag 10 as depicted in FIG. 2 has two concealed bag magnets 36. Again, more or fewer magnets can be employed as part of the magnetic closure system, as desired in keeping with the functional and design requirements for the individual article storage bag.

Figure 3:
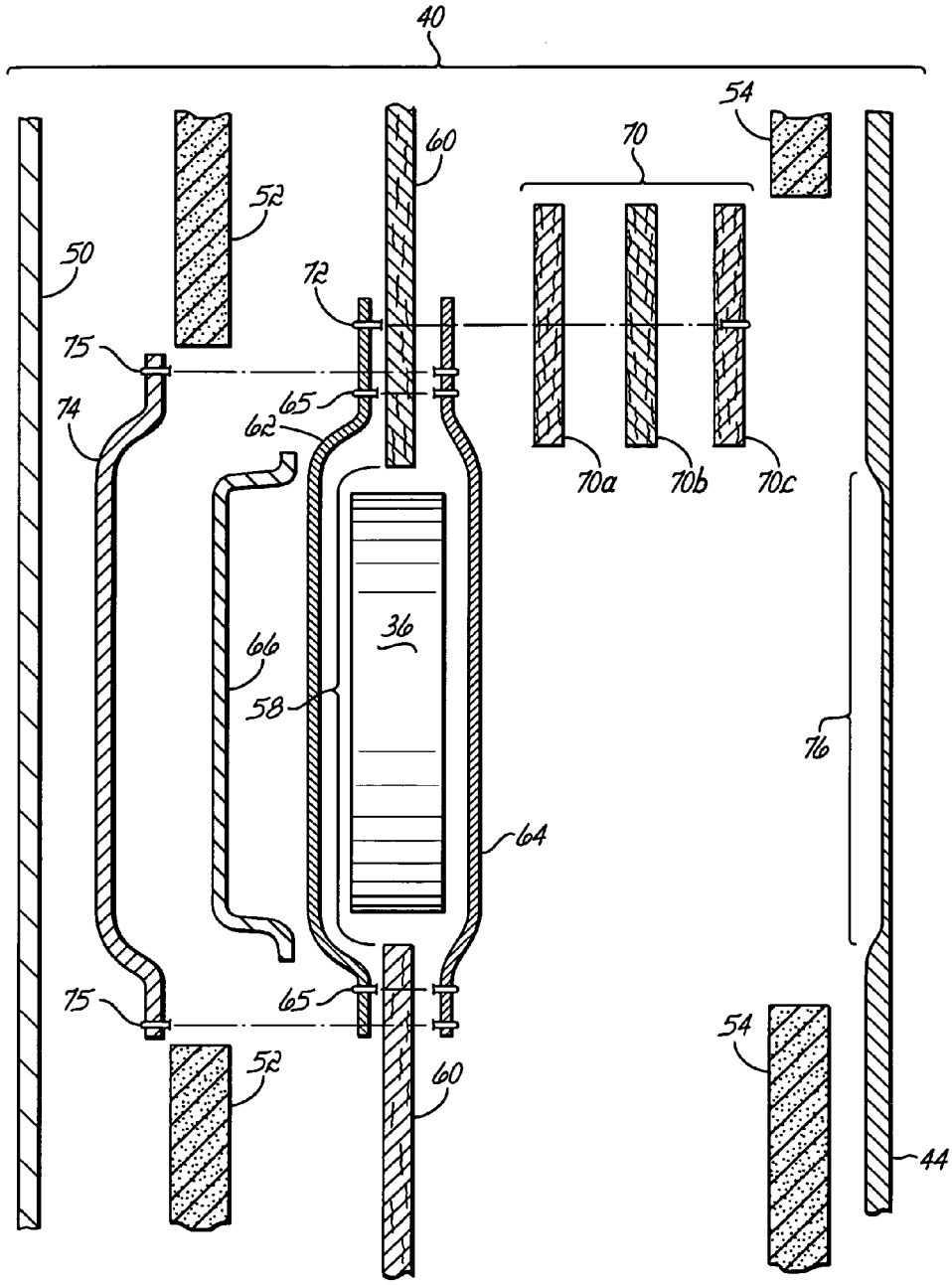
FIG. 3 is a partial cross-sectional expanded side view of the storage compartment side of the magnetic closure system.

The operation of the magnetic closure is shown in more detail in FIG. 3. The components making up, and surrounding, the magnetic closure include a bag side component 40 as identified at the top of FIG. 3. The bag side component 40 of the article storage bag 10 begins with bag facing layer 44; the flap side component 42, described below, begins with flap facing layer 46, shown in FIGS. 2 and 4.

Considering FIGS. 2 and 3 in combination, the first material of the bag side component 40 at the inside perimeter of an article storage compartment 32*b* or *c* is a pocket liner material 50. This material is generally durable, has a low weight, and is compatible with the contents to be stored. For example, the material may be nylon fabric.

Adjacent the pocket liner material 50 is a foam layer 52. The foam is open cell polyester with an uncompressed thickness of about 3/16 inch. The foam layer 52 is not applied over the entire length and width of the pocket. Rather, the foam is not used over the substrate material which retains the magnet, to be described below. Removing the foam layer removes a volume of material from this area, thereby helping to maintain a smooth appearance and feel on the inside of the article storage compartment 32*b* or *c*.

Between this foam layer 52 and the forward foam layer 54 adjacent the bag facing layer 44, is an assembly of layers attached to a relatively rigid, substrate sheet. This substrate sheet is an elastomeric rubber-impregnated fiberboard, available over a range of thicknesses and coating types. Though this type of substrate can be obtained from various sources, the particular substrate is obtained from Bontex Inc., Buena Vista, Va. 24416. The particular substrate 60 utilized in the bag side component 40 is Bontex® GF46 having a thickness of 0.050 inch, hereinafter identified as 0.050 Bontex®. This convention for identifying this type of Bontex® fiberboard by thickness will be used throughout.

Prior to installing the bag magnet 36, a circular hole 58 is cut in the substrate 60. This hole 58 has a diameter slightly larger than that of bag magnet 36. Though magnets of varying dimensions can be used, a circular magnet, in addition to providing good performance, does not have one or more sharp corners which could cause breakthrough of that corner through the covering material with time.

The magnet may be selected from a variety of types, both ferromagnetic and ceramic. Representative is a neodymium iron boron magnet with a cross-sectional thickness of 0.260 inches and a diameter of 1.0 inches. Magnets of this type can be obtained from Dexter Magnetic Technologies, Hicksville, N.Y. 11801. A representative magnet material from Dexter is identified as Grade 48, which is nickel plated. Though magnetic fields in the immediate vicinity of the magnet can have high flux density values, it is a property of the magnet that the flux density drops off considerably as one moves even short distances from the magnet.

The bag magnet 36 is suspended in the vicinity of the hole 58 cut into substrate 60 by individual adhesive-backed nylon tape layers, with the forward flat surface of bag magnet 36 generally flush with the side of the substrate 60 opposite foam layer 52. The nylon tape closest to the storage pocket is identified as pocket side tape 62. The nylon tape on the opposite side of magnet 36 is the facing side nylon tape 64. The nylon tape has a porous fabric construction, and is flexible but not deformable or stretchable to any degree. Representative tape products are available from Avon Tape Corporation, Brockton, Mass. 02403, such as #20 Natural color nylon cloth tape, 0.177 mm thick. Over time, the adhesive backing on both the pocket side nylon tape 62 and facing side nylon tape 64 may weaken, allowing the bag magnet 36 to slip and possibly become misaligned relative to the hole 58 in substrate 60 in which bag magnet 36 is located. To limit slippage of the bag magnet 36 relative to the nylon tapes 62 and 64, both nylon tapes 62 and 64 and substrate 60 are mechanically fastened together. This fastening process may take one of a number of forms, but typically is effected by applying a stitching line 65 through the pocket side nylon tape 62, facing side nylon tape 64 and substrate 60 generally uniformly around the hole 58 cut in substrate 60. Alternatively, the fastening process may mechanically bind the nylon tapes 62 and 64 to the substrate 60 in separate operations.

The magnetic flux density of the bag magnet 36 drops at a rapid rate in the area beyond the perimeter of the magnet. Nonetheless, a ferromagnetic dispersive plate 66 is positioned behind the pocket side nylon tape 62 to assist in minimizing the effect of a magnetic field on the contents stored in one or more of the article storage compartments 32*a, b* or *c*.

Above the hole 58 cut in substrate 60 is a ledge 70. The ledge is comprised of a non-ferromagnetic material which is secured to the substrate 60 through facing side nylon tape 64. When flap magnet 30 magnetically engages bag magnet 36, ledge 70 functions to limit upward lateral movement of flap magnet 30 away from bag magnet 36 when article storage bag 10 is carried using handle 16. The ledge 70 is mechanically fastened to substrate 60. The ledge was prepared from three layers of 0.050 Bontex® 70*a*, 70*b*, 70*c* secured one to the other using white latex glue, the composite in turn glued to substrate 60 through bag side nylon tape 64. Ledge 70 was then mechanically fastened by means of a stitching line 72 extending through ledge 70, facing side nylon tape 64, substrate 60, and pocket side nylon tape 62. Alternatively, the stitching line can be extended through the above layers with the exception of pocket side nylon tape 62, which optionally can then be mechanically fastened in a separate procedure, as desired.

To present a smooth feel within the pocket storage area behind the bag magnet 36, a circular disk of a protective material 74 having a larger diameter than the dispersive plate 66 is first adhered to the back of dispersive plate 66 using white latex glue. Then, stitching line 75 was applied around the perimeter of the protective material 74, the line extending through protective material 74 and substrate 60, to mechanically fasten the protective material 74 to substrate 60. The line may optionally run also through pocket side nylon tape 62 and facing side nylon tape 64 (shown). Whether stitching line 75 extends through one or more of pocket side nylon tape 62 and facing side nylon tape 64 depends in part on the diameter of protective material 74 relative to the respective lengths of nylon tapes 62 and 64. A representative protective material is leather cut into a circular shape. The thickness of the leather was approximately 1.25 mm.

The cross-sectional thickness of the bag facing layer 44 is preferably decreased as shown at area 76 in front of the bag magnet 36 to enhance the magnetic closure force between bag magnet 36 and flap magnet 30 through the intervening material layers. When the bag facing layer 44 is leather, and the bag magnet 36 is circular, the leather material is pattern split in an approximate circular shape to create area 76. The thickness of the leather in bag facing layer 44 at area 76 after pattern splitting is in the range of about 1 mm.

When the flap 14 overlies article storage portion 12 such that flap magnet 30 is attracted to the bag magnet 36, the flap facing layer 46 makes contact with the bag facing layer 44 over at least a portion of both of these layers.

Figure 4:
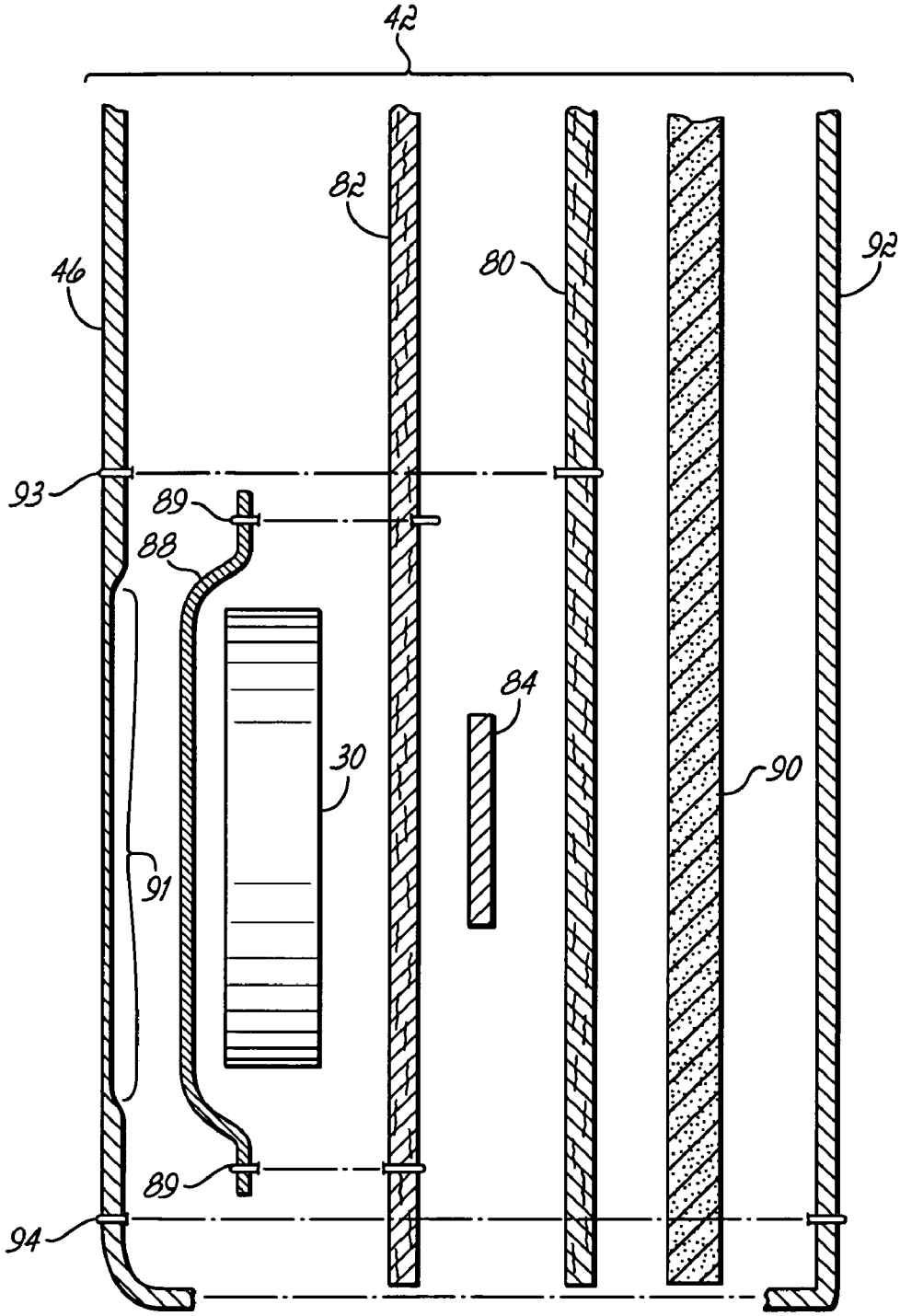
FIG. 4 is a partial cross-sectional expanded view similar to FIG. 3 of the flap side of the magnetic closure system.

As shown in FIG. 4, supporting the flap magnet 30 is a laminate of two pieces of 0.050 Bontex® substrate. The rear flap side substrate, 80, is bonded to the forward flap side substrate 82 via a glue layer, typically white latex glue. Between these two flap side substrates 80 and 82 is a spring steel bar 84 which is positioned behind the flap magnet 30 and extends the width of the flap 14, shown also in FIG. 2. The spring steel bar 84 has a thickness of approximately 1/32 inch and a height of approximately ½ inch. Bar 84 is ferromagnetic and assists in dissipating magnetic flux density from the flap magnets 30. Also, the stiffness imparted to the flap in the vicinity of the bar 84 and substrates 80 and 82 allows the flap 14 to be pulled from the bag magnets 36 with one hand.

Flap magnet 30 is attached to forward flap side substrate 82 by a glue layer, typically white latex glue. The flap magnet has the same construction, composition and dimensions as the bag magnet 36, but of opposite polarity to ensure a magnetic attraction to the mating bag magnet 36. Over the flap magnet 30 is applied at least one layer of nylon tape 88, this of the same composition as nylon tapes 62 and 64. To minimize slippage of the flap magnet 30 over time, this magnet is mechanically secured in place by a fastener. This fastener may be a stitching line 89 which encircles flap magnet 30 and binds nylon tape 88 to the forward flap side substrate 82.

Where the flap facing layer 46 is leather, and where the flap magnet is circular, the leather material immediately in front of flap magnet 30 is pattern split in an approximate circular shape to form area 91. The thickness of the leather in area 91 is approximately 1 mm. This pattern splitting assists in maintaining maximum closure force between flap magnet 30 and bag magnet 36 by decreasing the thickness of the non-magnetic layers between the magnets 30 and 36. Between the nylon tape 88 and flap facing layer 46 is typically a glue layer, of white latex glue. Because the nylon tape 88 is porous, the glue adheres through the pores of the nylon tape to both the mating side of flap magnet 30 and the underside of the flap facing layer 46.

Figure 5:
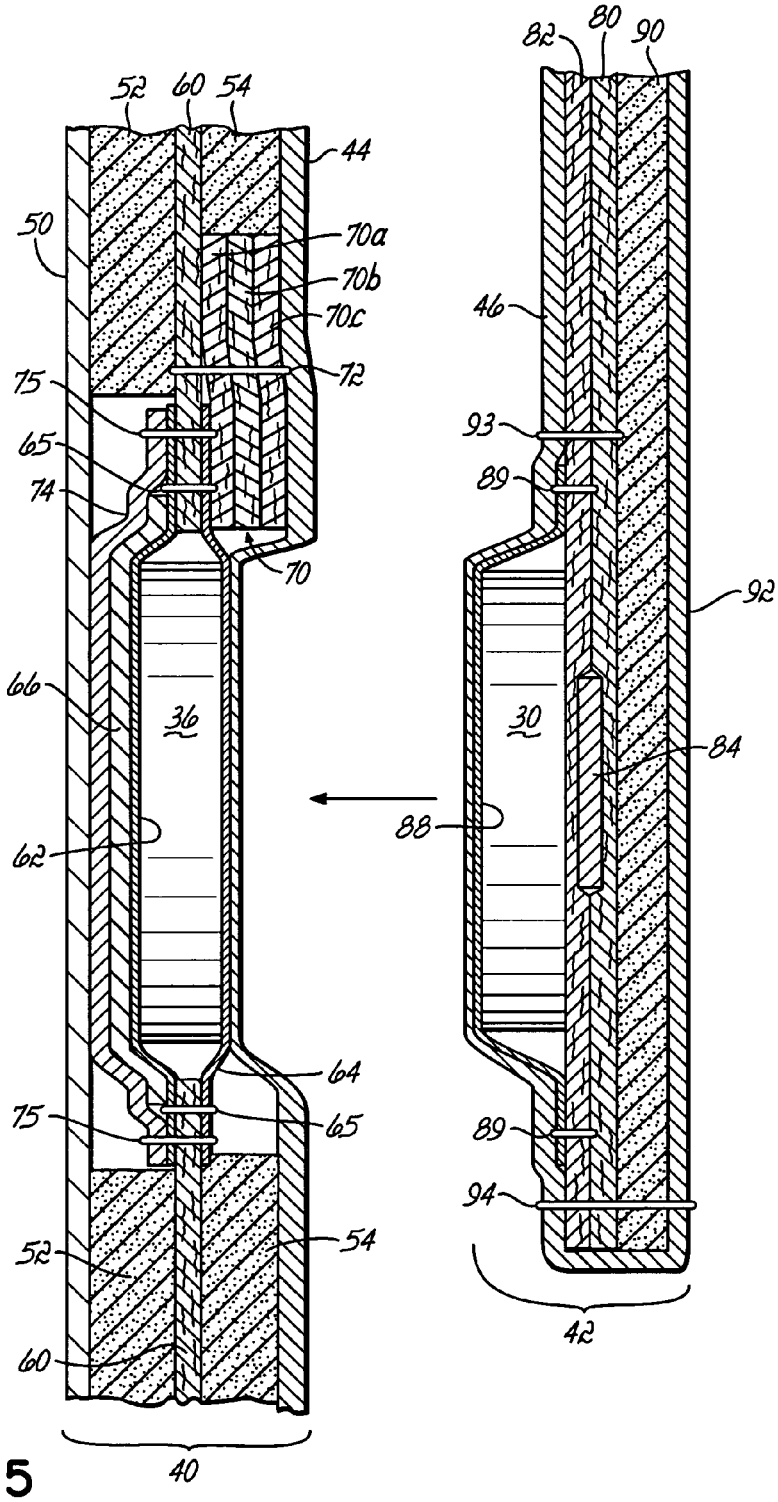
FIG. 5 is a partial cross-sectional disassembled view of the two assembled components of the magnetic closure system.

To modify the tactile feel of the flap, one or more layers of 3/16 inch open cell polyester foam 90 is applied behind rear flap side substrate 80. The flap construction is completed with a layer of material, that which is visible to the user when the flap is closed. Where the flap facing layer 46 is leather, typically the outer flap surface 92 is also leather. Stitching line 93 mechanically fastens the flap facing layer 46 to the rear flap side substrate 80 through forward flap side substrate 82. Stitching line 94 mechanically fastens the flap facing layer 46 through substrate layers 82 and 80, and foam layer 90 to the outer flap surface 92. The assembled components of the layers described above and depicted in FIGS. 3 and 4, are shown in FIG. 5.

Figure 6:
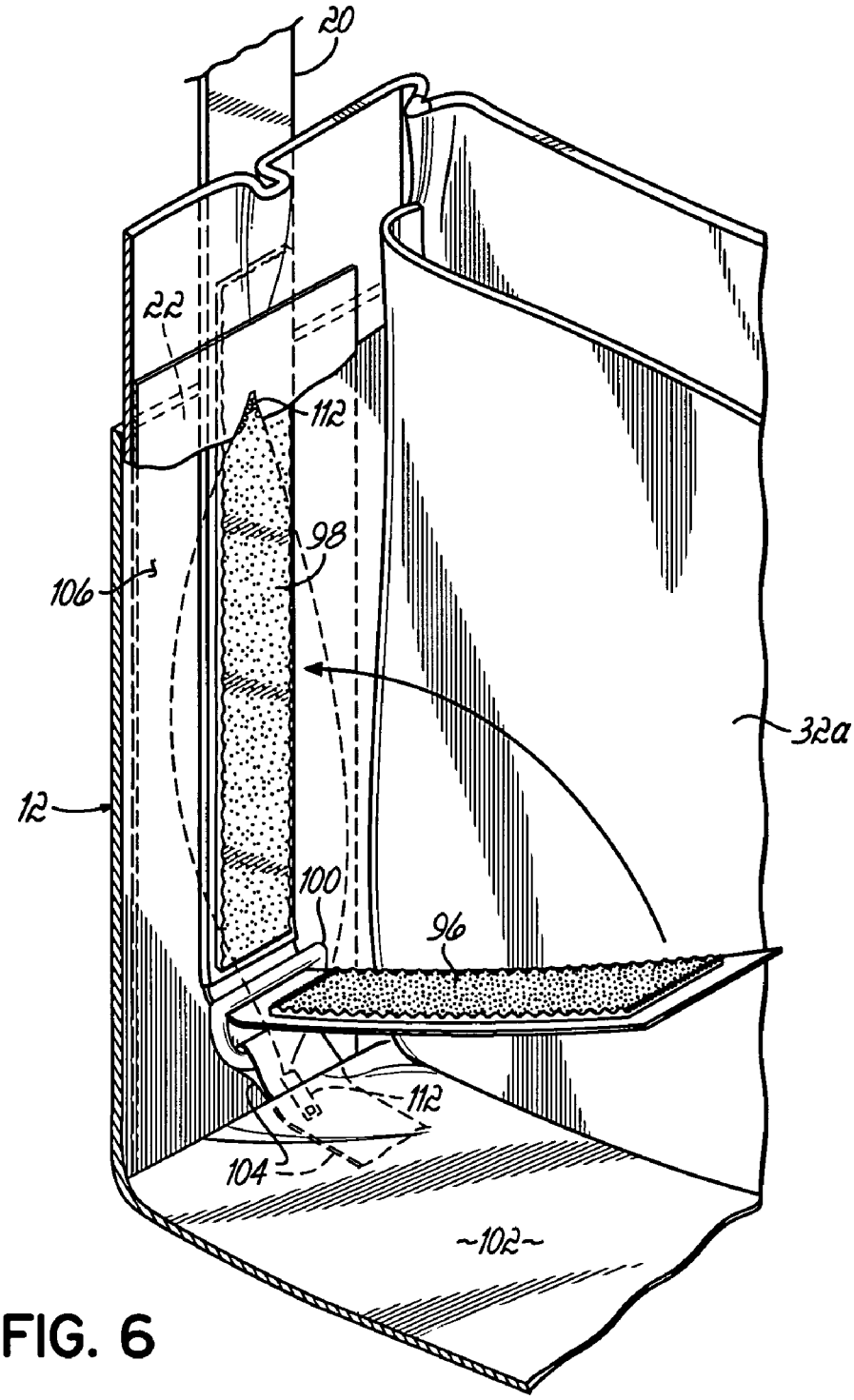
FIG. 6 is a partial cutaway view of the concealed strap adjustment system.

In regard to the concealed adjustment carrying strap feature, the carrying strap 20 can be adjusted to show varying lengths of exposed strap material, within limits, by adjustments carried out inside the article storage bag 10. As shown in FIGS. 1 and 6, the carrying strap 20 is inserted into receiver pocket 22 on both sides of the article storage bag 10. Note that FIG. 6 shows only one side of the article storage bag 10. Similar adjustment can be effected on the opposite side of article storage bag 10 by the same series of operations. The end of the carrying strap 20, as depicted, is comprised of a length of hook material 96 on a nylon fabric backing. The hook material is fastened to the end of carrying strap 20, such as by mechanically stitching the ends together, or by adhesively bonding the respective ends together.

Layered onto the end of the carrying strap 20 is a length of loop material 98. The loop material 98 is securely fastened to the end of the carrying strap 20. Fastening may be effected, for example, mechanically by stitching, or by adhesive bonding.

The hook material 96 is inserted into receiver pocket 22 and guided through D-ring 100, which is attached to the bottom 102 of the article storage bag 10 via a strap 104. This strap 104 is secured to the inside of article storage bag 10 in the vicinity of the edge defined by the bottom 102 and interior side wall 106 of article storage bag 10. After the hook material 96 at the end of carrying strap 20 is pulled through the D-ring 100, it can be brought into contact with loop material 98, thereby fixing the carrying strap 20 in place. As an example, and not by limitation, the loop material 98 can be fastened onto approximately the last six inches of carrying strap 20, with the hook material 96 extending approximately seven inches along the strap 20. The overall adjustability of the carrying strap 20 on each side of the article storage bag 10 in this example is approximately 6 inches, providing an overall adjustability of about 12 inches. Though hook and loop material is employed to provide adjustability for the carrying strap 20, it is contemplated that other incremental securing devices can be applied to the ends of the carrying strap 20.

To present a smooth internal surface in the article storage compartment 32*a*, side liner fabric 110 is openable and reclosable, such as by means of a zipper mechanism 112, or by other closure devices, such as an array of snaps or mating hook and loop material attached to the flaps comprising the side liner fabric 110. This feature in the liner fabric adjacent the adjustment components on strap 20 allows the adjustment operation of the carrying strap 20 to be completed, following which the carrying strap 20 is then isolated from contact with the inside storage area defined by article storage compartment 32*a*. After the adjustment operation is completed, the carrying strap 20 is secured to the article storage bag 10 through D-ring 100, strap 104 and thereby to the bottom 102 of the article storage bag 10.

Additional storage compartments can be designed into the article storage bag 10, as desired. Also, external storage areas, such as for storing writing instruments, business cards, small size documents and the like, can be stored on one or more external surfaces of the article storage bag 10.

After adjustment of the carrying strap 20 is completed, and flap 14 is closed over article storage portion 12, the resulting bag presents a smooth, finished appearance, with no externally viewable strap adjustment features nor any externally viewable means for securing the flap 14. Using the magnets specifically described, an article storage bag storing a laptop computer will remain closed when carrying the bag 10 via handle 16, withstanding a contents weight in excess of 15 pounds.

While the present invention has been illustrated by the description of embodiments thereof, and while the embodiments have been described in considerable detail, it is not intended to restrict or in any way limit the scope of the appended claims to such detail. Additional advantages and modifications will be readily apparent to those skilled in the art.

The invention in its broader aspects is therefore not limited to the specific details, representative apparatus and method, and illustrated examples shown and described. Accordingly, departures may be made from such details without departing from the scope or spirit of Applicant's general inventive concept.

What is claimed is:

1. A bag for storing and transporting articles, comprising:

an article storage container, having spaced apart front and rear portions, a bottom portion, and first and second side portions intermediate said front and rear portions, said front, rear, bottom, and side portions defining an interior storage volume of said bag for storing articles;

a first strap coupled to said bottom portion and securing a first anchoring ring inside said interior storage volume of said bag;

a second strap coupled to said bottom portion and securing a second anchoring ring inside said interior storage volume of said bag; and a carrying strap having two ends, each said end being selectively securable within said interior storage volume of said bag and engageable respectively with said first and said second anchoring rings, each said end having a releasable fastening component which allows each said strap end to be drawn through each said respective anchoring ring to a location on said carrying strap relative to each said anchoring ring and fastened to said location on said carrying strap inside said interior storage volume of said bag to prevent movement of said carrying strap relative to each said anchoring ring.

2. The bag of claim 1 further wherein said fastening component comprises discrete sections of hook and loop material.

3. The bag of claim 1 wherein each of said first and second anchoring rings is a D-ring.

4. The bag of claim 1 further comprising a flap overlying said article storage container.

5. The bag of claim 1 further comprising a carrying strap end receiver pocket external to said first side portion of said article storage container and external to said interior storage volume, said pocket configured to receive therethrough one of said ends of said carrying strap.

6. The bag of claim 5 further comprising a selectively openable and closeable access to said carrying strap end receiver pocket from said interior storage volume of said article storage container.

7. An article storage bag comprising:

a bag with opposed walls made of a material for fabricating said walls, said opposed walls defining at least one article storage volume;

a flap attached to said bag and made of a material for fabricating said flap, said flap positionable to overlie said at least one article storage volume of said bag;

at least one first magnet in said flap, said first magnet concealed by said material for fabricating said flap;

at least one second magnet in said bag opposed to said at least one first magnet when said flap is positioned to overlie said at least one article storage volume of said bag, said second magnet concealed by said material for fabricating said walls of said bag, said first and second magnets having opposed polarity such that a magnetic attraction is effected when said at least one first magnet and said at least one second magnet are brought to adjacent positions to affix said flap in a closed position relative to said bag as a result of said magnetic attraction; and a non-ferromagnetic projecting member in said bag concealed by said material for fabricating said walls of said bag, and forming a recess in said bag, said recess receiving said first magnet therein to thereby restrict movement of said first magnet relative to said second magnet when said first and second magnets are in said magnetic attraction and said bag is in an upright orientation; said material for fabricating said walls being located between the two magnets and also being located between the projecting member and the flap when the flap is in the closed position.

8. The article storage bag of claim 7 further comprising:

a handle on said flap, said handle for transporting said bag, said flap, and one or more articles stored in said at least one article storage volume, said at least one first magnet and at least one second magnet maintaining said flap in said closed position as a result of said magnetic attraction when said at least one article storage volume contains weight in excess of about 15 pounds.

9. The article storage bag of claim 7 wherein said material for fabricating said flap is leather and is formed with a portion facing said first magnet that has a lesser thickness than remaining portions of said material for fabricating said flap.

10. The article storage bag for claim 7 further wherein said first and second magnets are comprised of neodymium iron boron.

11. The bag of claim 4, further comprising:

at least one first magnet in said flap, said first magnet concealed by a material for fabricating said flap; and at least one second magnet in said bag opposed to said at least one first magnet when said flap is positioned to overlie said article storage container of said bag, said second magnet concealed by a material for fabricating said bag, said first and second magnets having opposed polarity such that a magnetic attraction is effected when said at least one first magnet and said at least one second magnet are brought to adjacent positions to affix said flap in a closed position relative to said article storage container as a result of said magnetic attraction.

12. The article storage bag of claim 7 further comprising a ferromagnetic dispersive plate.

13. An article storage bag comprising:

a bag with opposed walls made of a material for fabricating said walls, said opposed walls defining at least one article storage volume;

a flap attached to said bag and made of a material for fabricating said flap, said flap positionable to overlie said at least one article storage volume of said bag;

at least one first magnet in said flap, said first magnet concealed by said material for fabricating said flap;

at least one second magnet in said bag opposed to said at least one first magnet when said flap is positioned to overlie said at least one article storage volume of said bag, said second magnet concealed by said material for fabricating said walls of said bag, said first and second magnets having opposed polarity such that a magnetic attraction is effected when said at least one first magnet and said at least one second magnet are brought to adjacent positions to affix said flap in a closed position relative to said bag as a result of said magnetic attraction; and a non-ferromagnetic projecting member concealed by said material for fabricating said walls of said bag or said material for fabricating said flap and forming a recess in said bag or said flap, respectively, said recess in said bag or said flap configured to receive, respectively, said first or second magnet to thereby restrict movement thereof relative to the other of said first or second magnet when said first and second magnets are in said magnetic attraction and said bag is in an upright orientation; said material for fabricating said walls or said material for fabricating said flap being located between said two magnets when said flap is in the closed position;

said material for fabricating said flap being located between said projecting member and one of said walls of said bag when said flap is in the closed position if said projecting member is located in said flap and said material for fabricating said walls being located between said projecting member and said flap when said flap is in the closed position if said projecting member is located in said bag.

14. The article storage bag of claim 7, wherein said material for fabricating said flap is formed with a portion facing said first magnet that has a lesser thickness than remaining portions of said material for fabricating said flap, said portion of lesser thickness facing a first side of said first magnet, the article storage bag further comprising a fabric coupled to said material for fabricating said flap, said fabric facing a second side of said first magnet opposite said first side thereof, said fabric being coupled to said material for fabricating said flap so as to resist movement of said first magnet relative to said material for fabricating said flap.

15. The article storage bag of claim 14, wherein said fabric is porous for permitting the flow of adhesive therethrough.

16. The article storage bag of claim 15, wherein said fabric is made of nylon.

17. The article storage bag of claim 7, further comprising a top opening providing access into said storage volume, said projecting member being positioned above said second magnet and below said top opening when said bag is in the upright orientation.

18. An article storage bag comprising:

a plurality of walls made of a material for fabricating said walls and defining an article storage volume of the bag;

a flap coupled to at least one of said walls and made of a material for fabricating said flap, said flap positionable to overlie said storage volume;

a first closure element in said flap and concealed by said material for fabricating said flap, and a second closure element in one of said walls and concealed by said material for said walls, said first and second closure elements being magnetically attracted to one another and cooperating to affix said flap in a closed position relative to said storage volume; and a non-ferromagnetic projecting member in one of said walls or in said flap and concealed by said material for fabricating said walls or said material for fabricating said flap, said projecting member being concealed by said flap when said flap is in the closed position, said projecting member forming a recess in said one of said walls or in said flap, and being configured to receive said first or second closure element in the other of said flap or said one of said walls so as to restrict movement of said first and second closure elements relative to one another when said bag is in an upright orientation, said material for fabricating said walls being located between said two closure elements when said flap is in the closed position, said material for fabricating said flap being located between said projecting member and one of said walls of said bag when said flap is in the closed position if said projecting member is located in said flap and said material for fabricating said walls being located between said projecting member and said flap when said flap is in the closed position if said projecting member is located in said bag.

19. The storage bag of claim 18, wherein said first closure element includes a first magnet and said second closure element includes a second magnet.

20. An article storage bag comprising:

a container defining a storage volume for articles;

a flap attached to said container and positionable to overlie said storage volume, said flap having an open position providing access to said storage volume and a closed position restricting said access;

a handle extending from said flap;

a magnetic closure mechanism concealed from view when said flap is in the open position and when said flap is in the closed position, said closure mechanism including first and second closure elements respectively in said flap and said container and in magnetic attraction with one another when said flap is in the closed position to secure said flap in place relative to said container; and a non-ferromagnetic projecting member associated with said flap or with said container and concealed from view by a material for fabricating said flap or a material for fabricating said container, respectively, said projecting member forming a recess receiving said first or second closure element when said flap is in the closed position, wherein:

said first and second closure elements are concealed from view respectively by said material for fabricating said flap and by said material for fabricating said container;

said material for fabricating said container is located between said first and second closure elements when said flap is in the closed position; and said magnetic closure mechanism maintains said flap in place relative to said container when said article storage bag has articles in said storage volume and said article storage bag is carried by said handle, and said material for fabricating said flap is located between said projecting member and said container when said flap is in the closed position if said projecting member is located in said flap and said material for fabricating said container is located between said projecting member and said flap when said flap is in the closed position if said projecting member is located in said container.

21. The article storage bag of claim 20, wherein said magnetic closure mechanism maintains said flap in place relative to said container when said article storage bag has articles in said storage volume exceeding a weight of about 15 pounds and said article storage bag is carried by said handle.

* * * * *

UNITED STATES PATENT AND TRADEMARK OFFICE

CERTIFICATE OF CORRECTION

PATENT NO. : 7,806,309 B2
APPLICATION NO. : 11/363717
DATED : October 5, 2010
INVENTOR(S) : Michael D. Korchmar It is certified that error appears in the above-identified patent and that said Letters Patent is hereby corrected as shown below:

Column 9, lines 1-2, Claim 7 change "the two magnets and also being located between the projecting member and the flap when the flap is in the closed position." to -- said two magnets and also being located between said projecting member and said flap when said flap is in the closed position. --.
Column 9, line 16, Claim 10 change "storage bag for claim 7" to -- storage bag of claim 7 --.
Column 10, line 36, Claim 18 change "material for said walls," to -- material for fabricating said walls, --.

Signed and Sealed this
Seventh Day of February, 2012

David J. Kappos

David J. Kappos
*Director of the United States Patent and Trademark Office*